US005683074A

United States Patent [19]

Purvis et al.

[11] Patent Number: 5,683,074

[45] Date of Patent: Nov. 4, 1997

[54] TEMPORARY GUARDRAIL SYSTEM

[76] Inventors: Harrison G. Purvis, Rte. 1, Box 238D; Tony R. Matthews, 5316 Cross Holt Rd., both of Holy Springs, N.C. 27540

[21] Appl. No.: 755,596

[22] Filed: Nov. 25, 1996

Related U.S. Application Data

[63] Continuation of Ser. No. 421,858, Apr. 14, 1995, abandoned.

[51] Int. Cl.[6] ..... E04H 17/18

[52] U.S. Cl. ..... 256/67; 256/59; 256/65; 256/DIG. 6; 182/45; 182/113; 182/179; 248/158

[58] Field of Search ..... 182/45, 113, 179; 256/59, 65, 67, 68, 69, DIG. 6; 248/158

[56] References Cited

U.S. PATENT DOCUMENTS

| | | | |
|---|---|---|---|
| 725,458 | 4/1903 | Levy | 248/158 |
| 1,384,106 | 7/1921 | Taussig | 248/158 |
| 1,742,344 | 1/1930 | Davis | 248/158 |
| 2,203,113 | 6/1940 | Uecker et al. | 182/179 X |
| 2,569,632 | 10/1951 | Hauck | 403/230 |
| 2,603,456 | 7/1952 | Ruopp | 256/65 X |
| 2,744,729 | 5/1956 | Potts | 256/59 |
| 2,897,013 | 7/1959 | Delp | 182/179 X |
| 3,011,586 | 12/1961 | Harvey, Jr. | 182/179 X |
| 3,082,843 | 3/1963 | Leonard | 182/113 X |
| 3,084,761 | 4/1963 | Robertson | 182/179 X |
| 3,157,388 | 11/1964 | Nelson | 256/68 |
| 3,278,164 | 10/1966 | Leyendecker | 256/24 |
| 3,351,311 | 11/1967 | Melfi | 256/65 X |
| 3,370,836 | 2/1968 | Ashworth et al. | 256/65 X |
| 3,499,631 | 3/1970 | Heldenbrand | 256/59 X |
| 3,589,682 | 6/1971 | Dickey | 256/59 |
| 3,648,982 | 3/1972 | Sabel et al. | 256/65 |
| 3,844,520 | 10/1974 | Werner et al. | 256/59 X |
| 4,045,003 | 8/1977 | McCluskey et al. | 256/59 |
| 4,174,096 | 11/1979 | Campbell | 256/65 X |
| 4,208,038 | 6/1980 | Reid | 256/65 |
| 4,787,475 | 11/1988 | Arteau et al. | 256/DIG. 6 X |
| 5,145,153 | 9/1992 | Glynn | 256/DIG. 6 X |
| 5,431,372 | 7/1995 | Kostelecky | 256/59 X |
| 5,452,880 | 9/1995 | Bailey | 256/65 X |
| 5,456,451 | 10/1995 | Eyler, Jr. | 256/65 X |
| 5,547,169 | 8/1996 | Russell | 256/67 |

FOREIGN PATENT DOCUMENTS

| | | | |
|---|---|---|---|
| 260368 | 10/1964 | Australia | 256/59 |
| 2631048 | 11/1989 | France | 256/59 |
| 06322920 | 11/1994 | Japan | 256/59 |

*Primary Examiner*—Anthony Knight
*Assistant Examiner*—Andrea Chop
*Attorney, Agent, or Firm*—Mills & Associates

[57] ABSTRACT

This invention is an improved temporary guard rail system for use by residential and commercial builders on construction sites in those areas of building structures where an accidental fall may result in serious bodily injury. In particular, the temporary guard rail system of the present invention includes a plurality of upright stanchions having mounting brackets integrally formed or attached thereto that are connected by a plurality of vertically spaced, generally horizontal side rails extending end to end. The vertically spaced side rails are adapted for 360 degree rotational movement in both horizontal and vertical planes. In addition, the tubular guard rails are fabricated in a plurality of sections that may be slideably engaged, one inside another, to provide a telescoping adjustment of length. The temporary guard rail system may be adapted and secured to various features of a building such as balconies, elevated platforms, stair cases, and the perimeter of a floor prior to the external walls or permanent protective railings being erected to prevent accidental injury. Further, the temporary guard rail system is designed and manufactured to conform to OSHA requirements for temporary guard rails. This system also provides a versatile safety device which is easy to install, easy to dismantle, and relatively inexpensive to manufacture.

10 Claims, 5 Drawing Sheets

TEMPORARY GUARDRAIL SYSTEM

This application is a continuation of application Ser. No. 08/421,858, filed Apr. 14, 1995, now abandoned.

FIELD OF INVENTION

This invention relates to safety devices and more particularly to temporary guard rails used during construction of buildings.

BACKGROUND OF INVENTION

During the construction of buildings, both commercial and residential, there has been a problem in providing safety rails prior to permanent railings being installed on decks, balconies, and even elevated floors prior to the construction of exterior walls.

Quite often, 2×4 lumber has been temporarily nailed to form makeshift railings. Structures of this type, however, are usually not strong in structure and a worker or other person falling thereagainst can easily dislodge the makeshift railing causing such person to fall. This of course can result in grievous injury or even death.

The above mentioned problems are of such a serious nature that the Occupational Hazards Safety Act, or OSHA agency has become so alarmed that regulations have been promulgated to require temporary railings on all open elevated building structures that will withstand at least two hundred pounds pressure without failing. No structure, however, has been detailed to meet these requirements.

Concise Explanation of Prior Art

U.S. Pat. No. 2,910,135 to William P. Moore discloses a ladder scaffold with a guard rail which includes an upwardly projecting bolt with a wing nut that secures a telescopically adjustable railing in position.

U.S. Pat. No. 5,314,167 to Jesse H. Holloman discloses a temporary rail structure design to be used around the floor of a building during the construction process.

U.S. Pat. No. 3,351,311 to Samuel T. Melfi discloses a support for guard rails including wing nuts that hold both the top rail and the intermediate rail in position. However, the intermediate rails are not adjustable.

U.S. Pat. No. 4,830,341 to Jean Arteau, et al. discloses an anchor for mounting a temporary safety fence to a floor of a building under construction.

U.S. Pat. No. 3,662,993 to Anthony Lionetto discloses a protective guard fixture for open work areas in building construction having two vertical posts which support a barrier frame member.

U.S. Pat. No. 5,182,889 to Dennis Johnson discloses a barrier system having a plurality of elongated rod members and bracket system for attachment of the barrier to a structure.

U.S. Pat. No. 3,733,054 to Bernard Storch discloses a safety fence including a plurality of posts having brackets and telescopic rails which are coupled to an supported by the brackets.

U.S. Pat. No. 3,863,900 to Richard T. Dagiel, et al. discloses a guard assembly including a stanchion bracket which is designed for removable attachment to the outer edge of a concrete floor in combination with similar stanchion brackets.

U.S. Pat. No. 4,015,827 to Harold E. Brand discloses a stanchion including a base secured to a building support having a tubular receptacle carried on the base and supported thereon by an angular gusset.

Finally, U.S. Pat. No. Re 20,653 to Clyde K. Lamb is considered of general interest in that it discloses a guard rail for a scaffold having a plurality of posts adapted to be secured at one end of the scaffold and to extend vertically upwardly from the floor of the scaffold and the guard rail section supported between pairs of adjacent posts.

BRIEF DESCRIPTION OF INVENTION

After much research and study into the above mentioned problems, the present invention has been developed to provide a simple and yet highly efficient temporary railing system in accordance with OSHA requirements that can be readily installed when needed and just as readily removed when no longer required.

The present invention can be readily adapted to conform to varying building structure configurations. In particular, the temporary guard rail of the present invention includes a plurality of upright stanchions that are designed to be installed about the edge of an elevated platform, flight of stairs, or a floor area to support a plurality of vertically spaced, telescoping side railings.

Each of the upright stanchions of the temporary guard rail of the present invention include an anchor bracket integrally formed therewith for attaching the upright stanchions to the subfloor or framing members of the building under construction. The anchor brackets are provided with a plurality of mounting holes to permit the attachment of the same to the building structure with lag screws or other suitable fasteners. Typically, a pair or a series of these upright stanchions are attached to the subfloor in locations that present a potential for injury due to falls.

The individual stanchions are connected by upper and lower side rails which are pivotally mounted at a predetermined height on each upright stanchion. The pivoting side rail connectors with adapters permit the horizontal side rails to be rotated a full 360 degrees about the point of attachment on each upright stanchion either horizontally or at an angle. Thus, the guard rails may be adapted to virtually to any configuration encountered in a building under construction.

In view of the above, it is an object of the present invention to provide a temporary guard rail system that can be readily installed when needed and readily removed when no longer required.

Another object of the present invention is to provide a temporary guard rail system which may be readily adapted to virtually any configuration encountered in the building construction including elevated platforms, balconies, stairs, and the perimeter of the floor of the building prior to the construction of the exterior walls or permanent protective railings.

Another object of the present invention is to provide a temporary guard rail system that fully complies with the OSHA requirements for such temporary guard rails.

Other objects and advantages of the present invention will become apparent and obvious from a study of the following description and the accompanying drawings which are merely illustrative of such invention.

DETAILED DESCRIPTION OF INVENTION

Figure 2:
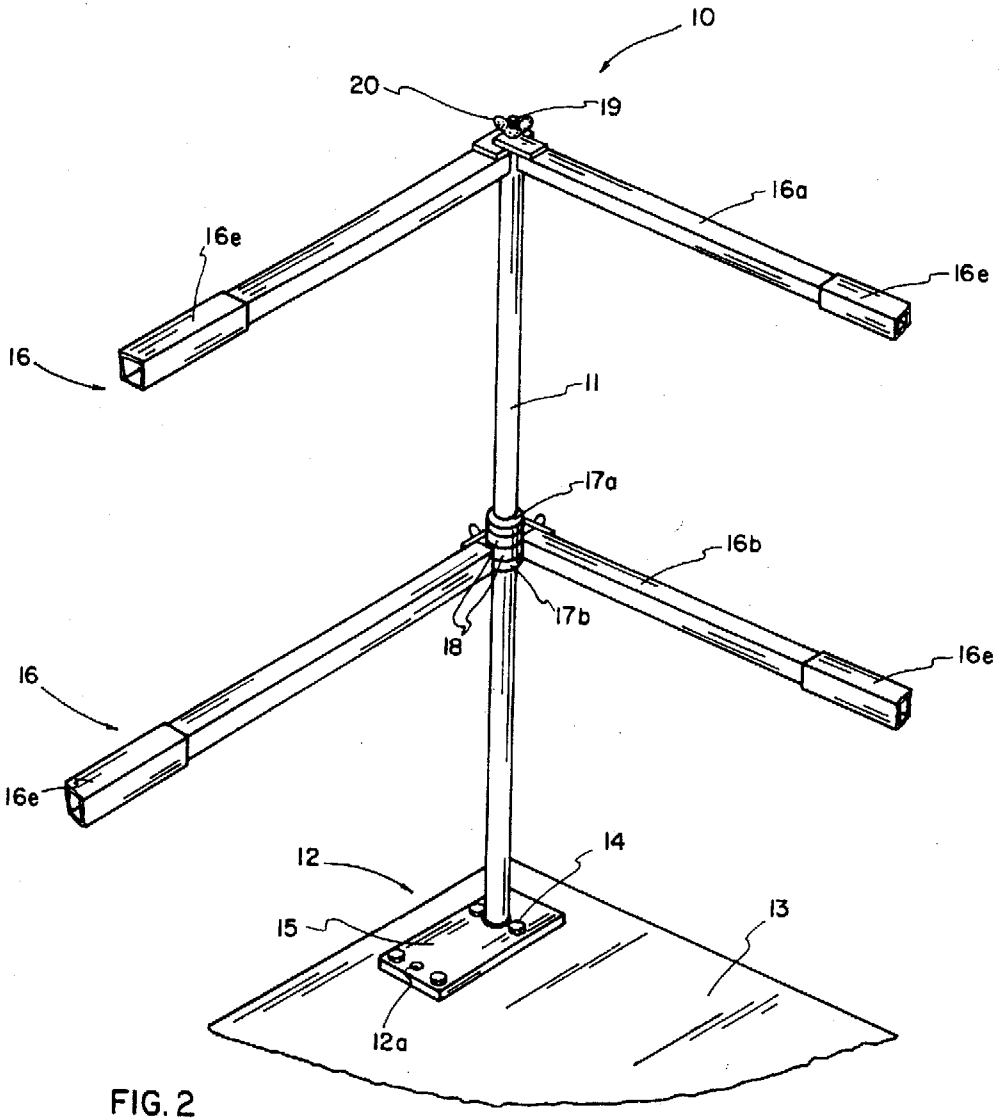
FIG. 2 is a perspective view of an upright stanchion showing sections of the telescoping, horizontal side rails mounted thereon and fastened to the floor of a structure.

With further reference to the drawings, the temporary guard rail system in accordance with the present invention is illustrated in FIG. 2 and indicated generally at 10.

Figure 1:
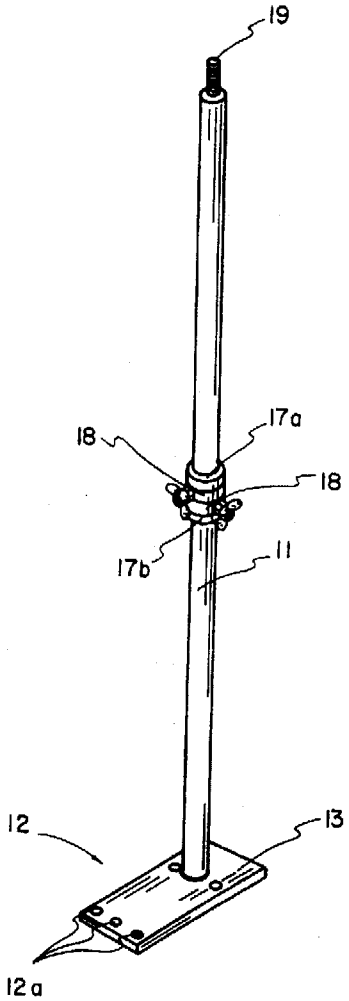
FIG. 1 is a perspective view of an upright stanchion that forms a part of the temporary guard rail system of the present invention.

The temporary guard rail system 10 comprises a plurality of upright stanchions 11 as shown in FIG. 1. In the preferred embodiment, stanchions 11 are formed from solid steel bars in order to comply with OSHA strength regulations. However, it will be appreciated that other materials such as aluminum, fiberglass and similar composites may be utilized in alternative embodiments.

The lower end of each stanchion 11 has integrally formed therewith or otherwise fixed thereto an anchor bracket, indicated generally at 12, for attaching each stanchion 11 to the building subfloor 13 or other suitable forming members (not shown). In the preferred embodiment, stanchion 11 is positioned in a predetermined location on anchor bracket 12 and is attached in perpendicular relation thereto by weldment or other suitable means as illustrated in FIG. 1.

As shown in FIG. 1, anchor bracket 12 includes a plurality of mounting apertures **12*a* extending through the same in predetermined locations. Mounting apertures 12*a* each have a center axis that is disposed in perpendicular relation to the plane of anchor bracket 12**.

Anchor bracket 12 may be securely attached to building subfloor 13 by installing a plurality of lag screws 14 or other suitable fasteners to secure stanchion 11 in position as illustrated in FIG. 2.

Referring to FIG. 2 it will be appreciated that stanchion 11 is positioned at a predetermined location on anchor bracket 12 which is offset in a lateral direction from a center point 15 of the top surface of anchor bracket 12.

The above predetermined positioning of stanchion 11 on anchor bracket 12 in conjunction with the predetermined location of mounting apertures **12*a* in anchor bracket 12 is designed to gain a mechanical advantage in counteracting the potential force which could be exerted against horizontal side rails, indicated generally at 16**, generated as a result of an adult or child falling against the same while moving through and around the building site thereby preventing serious bodily injury.

Still referring to FIG. 2, it will be appreciated that stanchion 11 has formed thereon an upper rail stop **17*a* and a lower rail stop 17*b*. Rail stops 17*a* and 17*b* are preferably fabricated as steel rings having an axial opening that is slightly larger than the outside diameter of stanchion 11. Upper rail stop 17*a* and lower rail stop 17*b* are disposed about the outside diameter of stanchion 11 and positioned at a predetermined vertical height generally corresponding to the vertical height of lower horizontal side rails 16*b*** as shown in FIG. 2.

It will be more clearly seen by referring to FIG. 1, that upper rail stop **17*a* and lower rail stop 17*b* are disposed about stanchion 11 in perpendicular relation to the longitudinal axis thereof. Rail stops 17*a* and 17*b* are positioned in spaced relation from each other to accommodate the installation of at least two rail support collars 18** therebetween as clearly seen in FIGS. 1 and 2.

In the preferred embodiment, rail support collars 18 are also fabricated from steel having an axial opening that is somewhat larger than the outside diameter of stanchion 11 but smaller than rail stops **17*a* and 17*b* enabling collars 18 to be freely rotated 360 degrees about the longitudinal axis of stanchion 11**.

Figure 3:
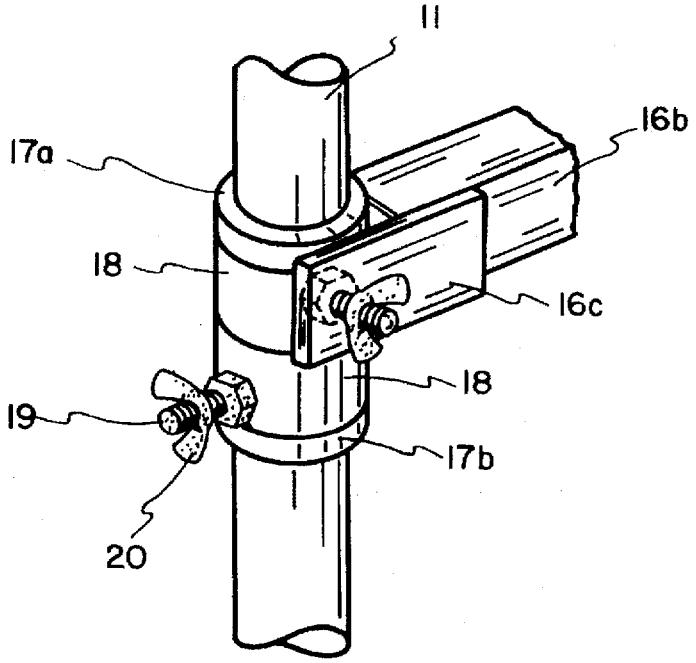
FIGS. 3 and 4 are enlarged perspective views of the pivoting collars for attaching the lower, horizontal side rails of the present invention.

Formed on the outside diameter of collars 18 are at least one threaded stud 19 extending outwardly therefrom in perpendicular relation to the longitudinal axis of stanchion 11 as shown in FIG. 3. In the embodiment shown, threaded studs 19 are fabricated from hexagonal steel stock and are attached to the exterior surface of collar 18 by weldment or other suitable means. There is also provided with each threaded stud 19 a wing nut 20 having cooperating threads for engaging therewith.

It will be understood that during the manufacturing process of stanchion 11 as shown in FIG. 3, rail stops **17*a* and 17*b* with at least two rail support collars 18 therebetween are slideably positioned at a predetermined location on stanchion 11. After the aforesaid components are precisely located in their operative positions, rail stops 17*a* and 17*b* are attached to stanchion 11 by weldment thereby permanently retaining collars 18. Collars 18 remain freely rotatable 360 degrees about the longitudinal axis of stanchion 11**.

Figure 4:
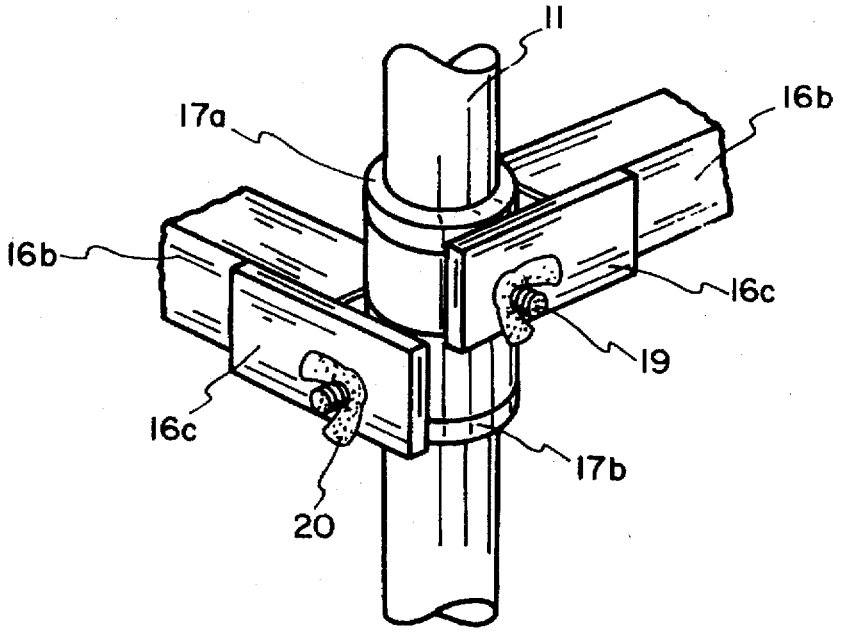

Referring now to FIG. 4, it can be seen that each end of lower horizontal side rails **16*b* includes a side rail extension bracket 16*c* that is attached in substantial linear alignment thereto by weldment. Side rail extension brackets 16*c* include at least one mounting aperture 16*f* through which threaded stud 19 may be inserted to mount lower horizontal side rails 16*b*** in their functional position as shown in FIG. 4.

Wing nut 20, or other suitable fastener, may then be screwed into engagement with extension bracket **16*c* to secure lower horizontal side rail 16*b*** in position.

It will be appreciated that lower side rail **16*b*** may now be rotated in a horizontal plane or pivoted vertically to conform to the shape of the building structure where it will be deployed.

Figure 5:
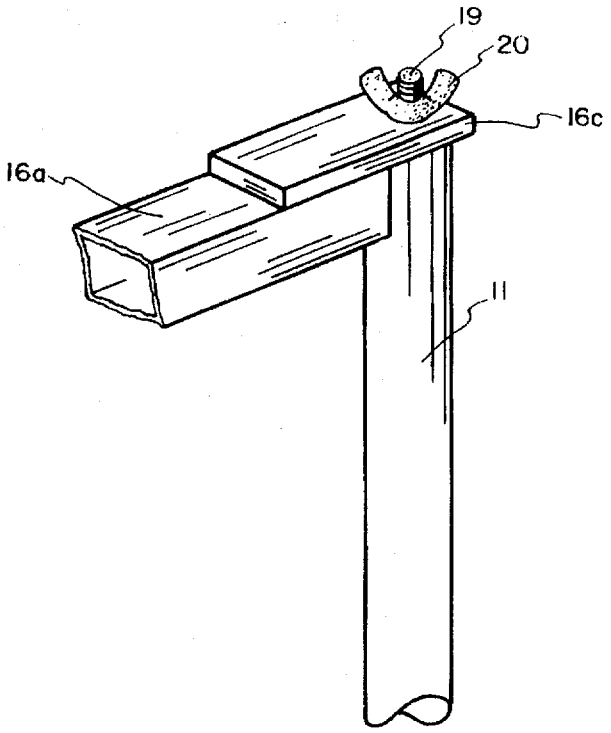
FIGS. 5 and 6 are enlarged perspective views of the top end of the upright stanchion showing the upper horizontal side rails attached thereto.

Now, turning to FIG. 5, there is shown the top end of upright stanchion 11 whereon an upper horizontal side rail **16*a* is secured. It will be seen that the top end of stanchion 11 includes a threaded stud 19 that is integrally formed or otherwise fixed thereon. There is also provided with threaded stud 19 a wing nut 20** including cooperating threads therein.

It can also be seen that upper side rail **16*a* includes a side rail extension bracket 16*c* that is disposed in substantial linear alignment with upper side rail 16*a* and attached thereto by means such as weldment. Extension bracket 16*c* is provided with at least one mounting aperture 16*f* for locating extension bracket 16*c* on threaded stud 19** in its functional position.

Figure 6:
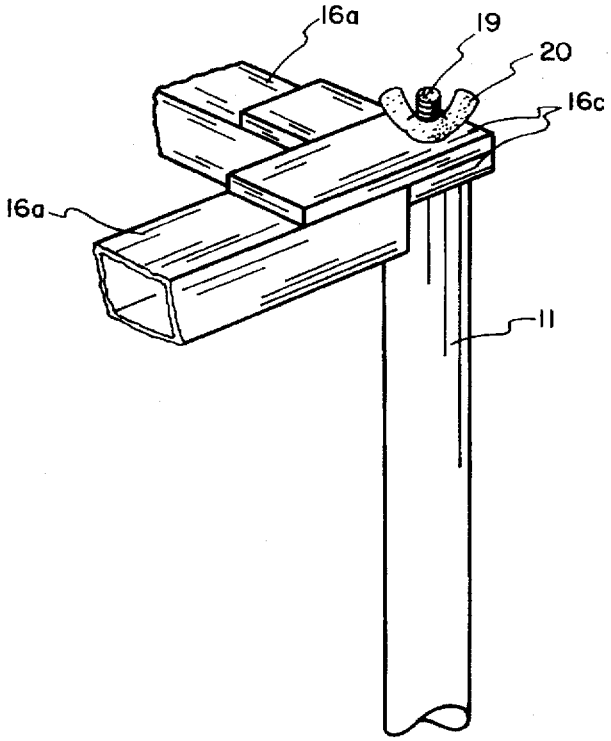

Referring now to FIG. 6, it will be appreciated that at least two side rail extension brackets **16*c* and their corresponding upper side rails 16a may be positioned on threaded stud 19 and secured in this position by engagement with wing nut 20**.

It will be appreciated that upper horizontal side rails 16a may also be rotated 360 degrees in perpendicular relation to the longitudinal axis of stanchion 11 to conform to the shape of the building structure or construction site where it is to be utilized.

Figure 7:
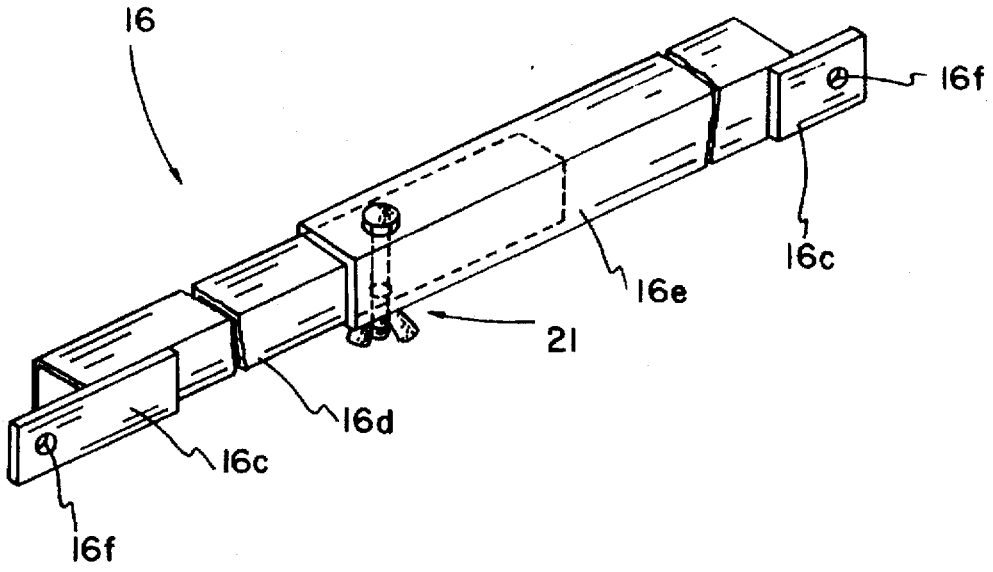
FIG. 7 is an enlarged perspective view of the telescoping segments comprising each respective side rail.

Now, turning to FIG. 7, there is shown therein a detailed view of the telescoping side rail of the present invention, indicated generally at 16. In the preferred embodiment, side rail 16 is composed of two individual segments, namely internal segment 16d and external segment 16e. It will be understood that both internal segment 16d and external segment 16e are fabricated from steel tubing that is generally rectangular in cross section. In particular, internal segment 16d is fabricated to an outside dimension that is slightly smaller than the inside dimension of external segment 16e.

Figure 7A:
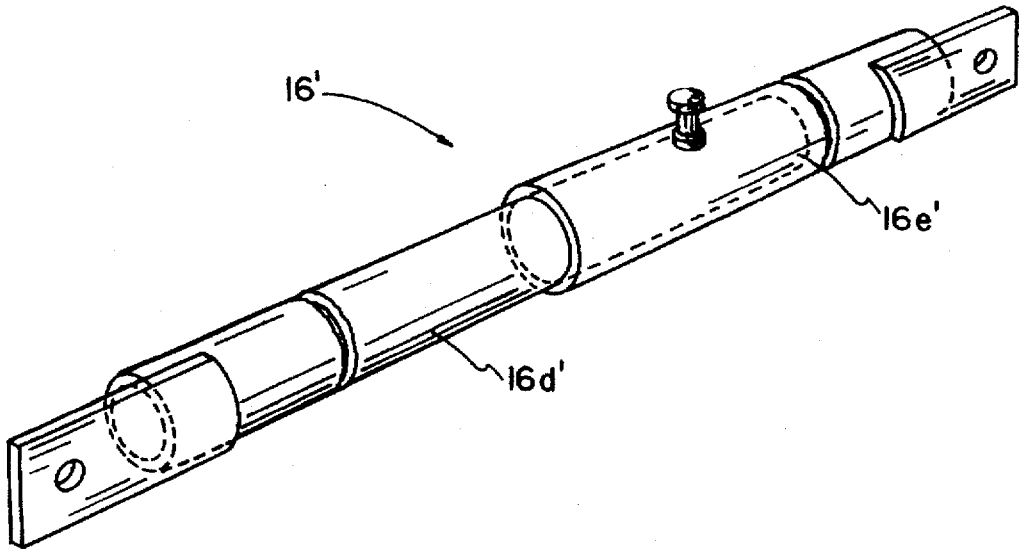
FIG. 7A is a perspective view showing an alternative embodiment of a telescoping, horizontal side rail wherein the side rail is cylindrical in cross-section.

Accordingly, internal segment 16d may be slideably engaged with the inside surface of external segment 16e in a telescoping manner. Hence, horizontal side rails 16 may be adjusted in length to conform to the dimensions of the building structure on the construction site where it is to be installed. In an alternative embodiment, side rails 16' may be fabricated from steel tubing that is cylindrical in cross section as shown in FIG. 7A. In this embodiment an internal segment 16d' is fabricated to an outside diameter that is slightly smaller than the inside diameter of external segment 16e'.

Similarly, internal segment 16d' may be slideably engaged with the inside surface of external segment 16e' in a telescoping manner. Hence, the horizontal side rails 16' may be adjusted in length to conform to the dimensions of the building structure on the construction site where it is to be installed.

The telescoping ends of internal segment 16d and external segment 16e may be provided with a suitable locking means, such as that indicated generally at 21, for securing the telescoping side rail 16 in a fixed position after it has been adjusted to the desired length.

It is noteworthy that each respective telescoping side rail 16 as shown in FIG. 6 is manufactured to the same specifications and, thus, upper side rails 16a and lower side rails 16b are functionally interchangeable. The respective numerical designations herein are provided for purposes of clarification only.

Figure 8:
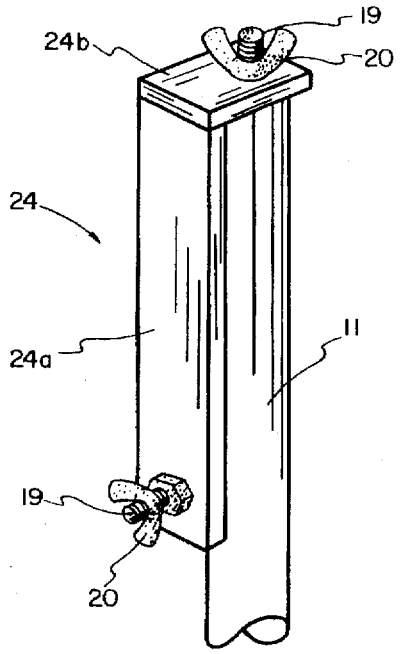
FIG. 8 is an enlarged perspective view of the top end of the upright stanchion showing an adapter for stair railings attached thereto.
Figure 9:
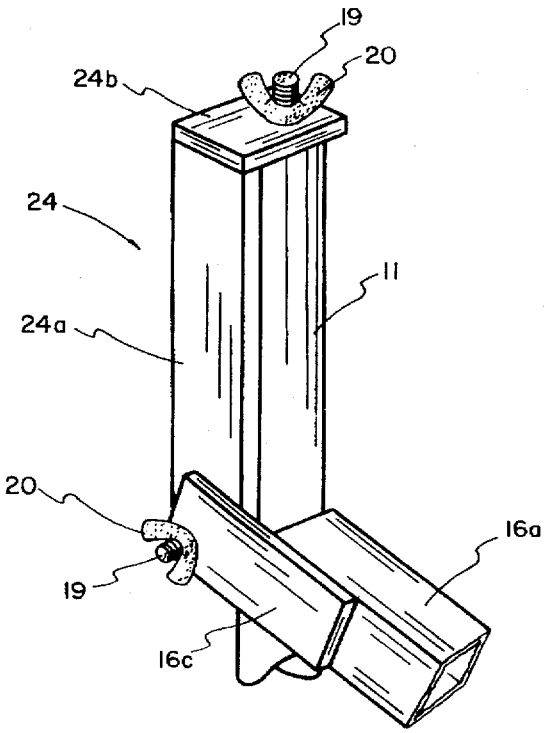
FIG. 9 is an enlarged perspective view of the top end of the upright stanchion showing the stair rail adapter of FIG. 8 having a stair railing attached thereto at an angle.

Referring now to FIG. 8, there is shown a stair adapter bracket, indicated generally at 24, designed to receive and support upper side rails 16a at varying angles in relation to upright stanchion 11 and particularly in those instances where the temporary guard rail system is utilized as a hand rail on a flight of stairs or other inclines.

Stair adapter bracket 24 is L-shaped, having a long member 24a and a short member 24b. In the preferred embodiment, stair adapter bracket 24 is fabricated from steel plate material and long member 24a is bent or attached in perpendicular relation to short member 24b by weldment.

Short member 24b is provided with a mounting aperture (not shown) at a predetermined location designed to receive threaded stud 19 that outwardly projects from the top of stanchion 11 such that long member 24a of stair adapter 24 is disposed in substantial parallel relation to the top of stanchion 11 as shown in FIG. 8.

There is also provided at the distal end of long member 24a a threaded stud 19 that is disposed in perpendicular relation to the plane defining member 24a. Threaded stud 19 is provided with a wing nut 20 having compatible threads therein.

In this particular application, anchor brackets 12 are attached to the treads of a convention flight of stairs or other inclines at various intervals. Upper side rails 16a are mounted on threaded stud 19 at the distal end of long member 24a of the stair adapter bracket 24. Wing nut 20 is screwed into engagement with side rail extension bracket 16c. Thereafter, the respective stanchions 11, each having a stair adapter bracket 24 installed thereon, are connected by a plurality of side rails 16a that extend from end to end down the flight of stairs or other inclines.

It will be appreciated that side rail extension bracket 16c is designed and fabricated to provide sufficient clearance between the end of upper side rail 16a and stair adapter bracket 24 to enable side rail 16a to be pivoted at varying angles to vertical without binding against adapter bracket 24.

It is understood that lower side rails 16b are designed and fabricated to enable this same pivoting movement at varying angles to vertical without special adaptation.

It is reiterated that the temporary guard rail system 10 of the present invention has been designed and fabricated to comply with OSHA standards for temporary guard rails.

From the above it can be seen that the present invention provides a temporary guard rail system that may be readily adapted to any feature of a building that is under construction to protect against the potential for serious bodily injury from falls particularly when the construction site is unsupervised.

The terms "upper", "lower", "side", "top", "bottom" and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. An improved temporary guardrail system for removable attachment to a building under construction including a plurality of upright stanchions, said stanchions being connected by a plurality of vertically spaced, upper and lower horizontal side rails, the improvements comprising:

anchoring means being fixedly attached at a bottom end of each of said stanchions, said anchoring means including a rectangular plate, said plate being fixedly attached to said bottom end of each of said stanchions in perpendicular relation thereto, each of said stanchions being located at a point that is laterally offset from a center point of said plate such that mechanical advantage is gained in counteracting a force generated by a person falling against said upper and lower horizontal side rails when said anchoring means is attached to said building, each of said stanchions including a first threaded stud projecting upwardly and outwardly from a top end thereof in axial alignment therewith enabling each of said upper horizontal side rails to be rotatably mounted thereon at any angular relationship in a horizontal plane;

means for rotatably connecting said upper and lower side rails to said stanchions enabling each respective upper and lower side rail to be rotated up to 360 degrees about a longitudinal axis of each respective stanchion in a horizontal plane and each respective upper and lower side rail to be pivoted at varying angles in a vertical plane;

means for telescopically adjusting the length of each respective upper and lower side rail enabling said temporary guardrail system to be adapted to various structural features of said building; and angulation means attached to said first threaded stud enabling said upper side rails to be attached thereto and pivoted in a vertical plane at varying angles in relation to said stanchion, said angulation means including an L-shaped stair and incline adapter bracket disposed on said first threaded stud at said top end of said stanchion, said bracket including a second threaded stud disposed in perpendicular relation to the longitudinal axis of said stanchion permitting said upper side rails to be mounted thereon and pivoted in a vertical plane at varying angles for installation of said temporary guardrail system on inclines and flights of stairs.

2. The temporary guard rail system of claim 1 wherein said rotatable connecting means for said lower side rails comprises at least one rail support collar cooperating with each of said lower side rails, said at least one collar being disposed about said stanchion, and at least one threaded stud outwardly projecting from said rail support collar perpendicular to a center axis of said collar enabling a lower side rail to be fixedly mounted on said rotatable connecting means.

3. The temporary guard rail system of claim 2 wherein said rail support collars are disposed about said stanchion at a predetermined vertical location in an operative relationship between at least two rail stops.

4. The temporary guard rail system of claim 3 wherein said rail stops are fabricated from steel.

5. The temporary guard rail system of claim 4 wherein said rail stops are attached to said stanchion by weldment.

6. The temporary guard rail system of claim 1 wherein said telescopically adjusting means comprises each of said upper and lower side rails having a plurality of tubular sections that are slideably engaged one inside another whereby the length of said upper and lower side rails is made adjustable.

7. The temporary guard rail system of claim 6 wherein said telescopically adjusting means includes a locking means.

8. The temporary guardrail system of claim 6 wherein said tubular sections are generally rectangular in cross section.

9. The temporary guardrail system of claim 6 wherein said tubular sections are generally cylindrical in cross section.

10. The temporary guard rail system of claim 1 wherein a plurality of mounting apertures are formed adjacent the peripheral edges of said anchoring means, said apertures being adapted to receive fasteners therein for attaching said anchoring means to said building structure.

* * * * *